US007270040B2

(12) United States Patent
King et al.

(10) Patent No.: US 7,270,040 B2
(45) Date of Patent: Sep. 18, 2007

(54) CUTTING HEAD MOUNTING AND SUPPORT RING SYSTEM

(75) Inventors: Daniel W. King, Valparaiso, IN (US); Michael S. Jacko, Chesterton, IN (US); Paul Arrasmith, Valparaiso, IN (US)

(73) Assignee: Urschel Laboratories Inc., Valparaiso, IN (US)

( * ) Notice: Subject to any disclaimer, the term of this patent is extended or adjusted under 35 U.S.C. 154(b) by 41 days.

(21) Appl. No.: 10/825,157

(22) Filed: Apr. 16, 2004

(65) Prior Publication Data

US 2004/0216572 A1 Nov. 4, 2004

Related U.S. Application Data

(60) Provisional application No. 60/466,403, filed on Apr. 30, 2003.

(51) Int. Cl.
*B26D 7/26* (2006.01)

(52) U.S. Cl. ..... 83/403; 83/698.41; 403/350

(58) Field of Classification Search ..... 83/403, 83/698.41; 403/348–352
See application file for complete search history.

(56) References Cited

U.S. PATENT DOCUMENTS 2,101,679 A * 12/1937 Hull ..... 403/24
2,400,818 A * 5/1946 Gallagher ..... 192/46
2,596,604 A * 5/1952 Schaeffer ..... 241/280
2,873,131 A * 2/1959 Metrailer ..... 403/348
3,784,215 A 1/1974 Ruthenberg
4,050,702 A 9/1977 Del Matto
RE30,680 E * 7/1981 Kress et al. ..... 464/177
4,799,626 A * 1/1989 Hickel et al. ..... 241/37.5
5,133,617 A * 7/1992 Sokn et al. ..... 403/349
5,344,162 A 9/1994 Kernon et al.
5,694,824 A 12/1997 Jacko et al.

* cited by examiner

*Primary Examiner*—Kenneth E. Peterson
(74) *Attorney, Agent, or Firm*—Bacon & Thomas, PLLC

(57) ABSTRACT

A cutting head mounting and supporting ring assembly having an interlocking joint arrangement for mounting the cutting head on a food slicing machine. The ring assembly includes a support ring having a plurality of circumferentially spaced, radially extending flange segments having a flange end portion inclined relative to the axis thereof, and a mounting ring having a plurality of circumferentially spaced axially extending protrusions having a protrusion end portion inclined relative to the axis thereof. The flange and protrusion surfaces of the flange segments and the protrusions are complementary shaped and arranged to mutually engage face-to-face to define scarf type joint connections when they are interdigited.

14 Claims, 3 Drawing Sheets

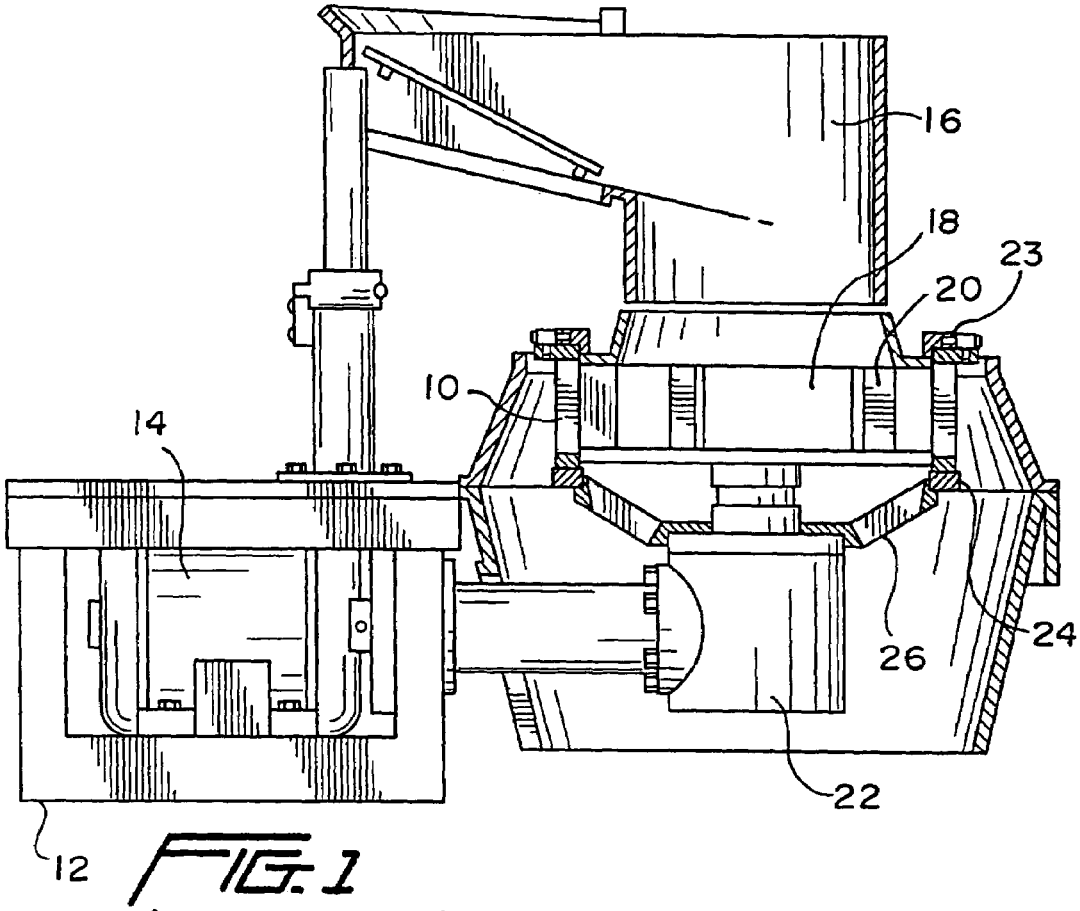
FIG. 1
(PRIOR ART)
FIG. 2
(PRIOR ART)
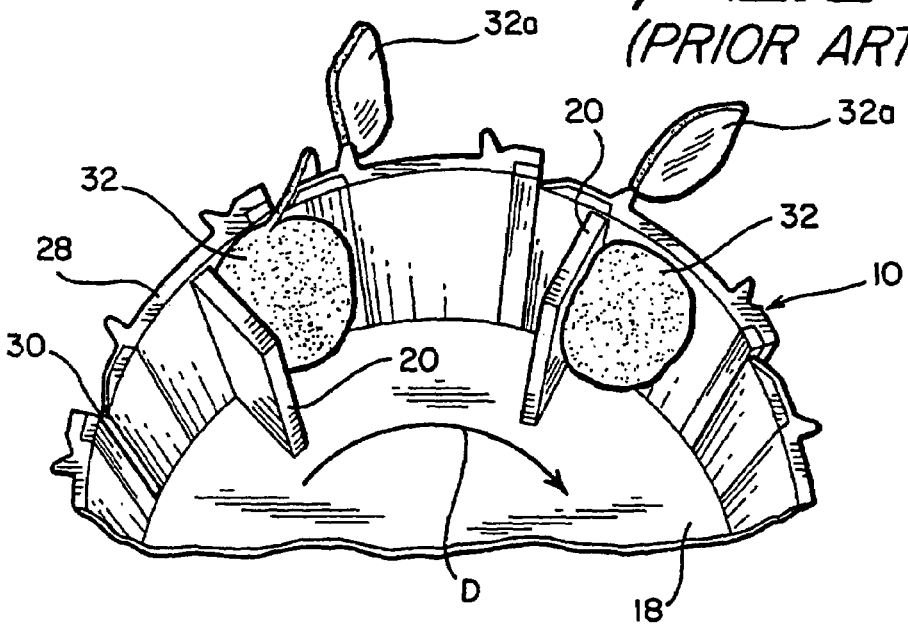

CUTTING HEAD MOUNTING AND SUPPORT RING SYSTEM

This application claims the benefit of provisional application No. 60/466,403 filed Apr. 30, 2003.

BACKGROUND OF THE INVENTION

1. Field of the Invention

The present invention relates to a cutting head mounting and support ring system for securing a cutting head to a food slicing machine.

2. Discussion of Related Art

Slicing machines for cutting food products, such as vegetables, nuts, and fruit, are well known in the art. A known apparatus is described in U.S. Pat. No. 5,694,824 and comprises a main frame, a drive motor, a stationary annular cutting head fixedly attached to the main frame and having a series of circumferentially spaced cutter support segments each with a slicing blade mounted thereon, and a rotatable impeller surrounded by the cutting head and connected to a drive motor for rotation within the cutting head. The cutting head and the impeller are configured so that the impeller directs a food product outwardly against the slicing blades when the impeller is rotated within the cutting head.

In the known apparatus described in U.S. Pat. No. 5,694,824, a cutting head mounting ring located on the bottom of the cutting head is received on a fixed support ring of a slicing machine. The cutting head is gravitationally held on the support ring with axially extending pins serving to retain the support ring relative to the mounting ring. The cutting head is separated from the mounting ring for cleaning and maintenance simply by lifting the cutting head and mounting ring from the support ring.

In such known machines, it is necessary to often change the cutting head in order to replace or clean the cutting head and/or the slicing blades. Removal of the cutting head, or replacement or adjustment of the slicing blades is typically a time consuming procedure and thereby reduces production efficiency. Removal or adjustment of the cutting heads must therefore be accomplished with minimal down time of the slicing machine.

As discussed above in relation to the slicing apparatus described in U.S. Pat. No. 5,649,824, the known cutting head includes an upper annular ring mounted on an upper side of the cutter segments and is connected to the support ring through a mounting ring mounted on a lower side of the cutter segments by pins that extend axially or downwardly from the cutter support segments and engage locating holes formed adjacent to the periphery of the support ring. In this particular coupling arrangement, it has been observed that the pins of the cutting head may deform or the locating holes may elongate on the support ring over time, thereby rendering it difficult to properly position the cutting head on the support ring after repeated usage.

In another known slicing apparatus, a coupling arrangement is provided that includes a lower mounting ring upon which the cutting head may be attached. The lower mounting ring, in turn, is arranged to simply rest on and be frictionally supported by the support ring.

In the known coupling arrangements, it has been observed that the cutting head and its mounting ring can be lifted or tilted relative to the support ring under some conditions of slicing operations when heavy surges of food products enter the impeller and result in impeller imbalance. When the impeller imbalance occurs, the impeller may impact the slicing blades and damage components of the cutting head and the impeller itself. Damage to the cutting head and impeller may result in poor quality of the sliced food product, and further necessitate replacement of the cutting head and/or impeller.

Accordingly, an improved coupling arrangement between a mounting ring and a support ring of a food slicing machine is desirable to prevent tilting or lifting of the cutting head relative to the support ring during slicing operations. It is also desirable to provide an improved coupling arrangement that improves the durability of the mounting and support rings during use, and that reduces or eliminates the possibility of damage to the cutting head and impeller from repeated removal and replacement activities. It is also desirable to reduce the down time of slicing machines and to simplify the process of removing or mounting a cutting head from and to a slicing machine support ring.

SUMMARY OF THE INVENTION

The present invention resides in a cutting head mounting and support ring assembly for a food slicing machine, and which includes an interlocking joint arrangement for connecting a pair of rings together so that the cutting head is restrained against tilting movement during operation of the slicing machine. More specifically, in accordance with a preferred embodiment, an improved ring coupling arrangement is disclosed for connecting a support ring and a mounting ring together in a slicing apparatus wherein the support ring has a plurality of circumferentially spaced, radially extending flange segments that have a surface inclined relative to the rotational axis of the impeller, and a mounting ring having a plurality of circumferentially spaced axially extending protrusions having a surface inclined relative to the rotational axis of the impeller. The inclined surfaces of the flange segments and the protrusions are complementary shaped and arranged to mutually engage face-to-face with one another to define scarf type joint connections when they are interdigited.

The mounting ring of the invention is arranged to be secured to the cutting head and to be received by the support ring in a co-axial relationship. When received by the support ring fixedly attached to the main frame of the slicing machine, the mounting ring may be manually rotated in the driving direction of rotation of the impeller of the slicing machine. As the mounting ring is rotated, the inclined surfaces of the protrusions will interlock with corresponding inclined surfaces of the flange segments of the support ring to define scarf joints.

The inclined surfaces of the mounting and support rings are configured so that continued rotation of the mounting ring in the driving direction of the impeller is prevented relative to the support ring. During a slicing operation, the force of the impeller within the cutting head tends to drive the mounting ring protrusions into and against the support ring flange segments so that the support and mounting rings become rigidly coupled axially and circumferentially to each other. Upon completion of the slicing operation, the mounting ring may be uncoupled from the support ring merely by reverse rotating the mounting ring in the direction opposite to the driving direction of rotation of the impeller.

The features of the interlocking joint arrangement of the invention reduce the potential for the tilting or lifting of the cutting head relative to the support ring during slicing operations mounting ring. Furthermore, the interlocking joint arrangement of the invention increases the efficiency of mounting a mounting ring to a support ring, and as a result, the process for removing or mounting a cutting head to a slicing machine is rendered less time consuming. It will also be understood that the interlocking joint arrangement of the invention does not require fastener devices to secure the mounting ring to the support ring, and thus, the coupling arrangement between the support ring and the mounting ring is simplified and the durability of the support ring and mounting ring is improved over known coupling arrangements. Moreover, it will be understood that the inclined surfaces of the mounting and support rings require only simple machining operations to be formed, and will permit effective interlocking despite excessive wear due to their simple, wedge-like nature.

BRIEF DESCRIPTION OF THE DRAWINGS

FIG. 1 is a side view of a known slicing machine having a known cutting head configuration;

FIG. 2 is a partial perspective view illustrating the known slicing of a food product by the known slicing machine;

DETAILED DESCRIPTION OF THE INVENTION

Figure 3:
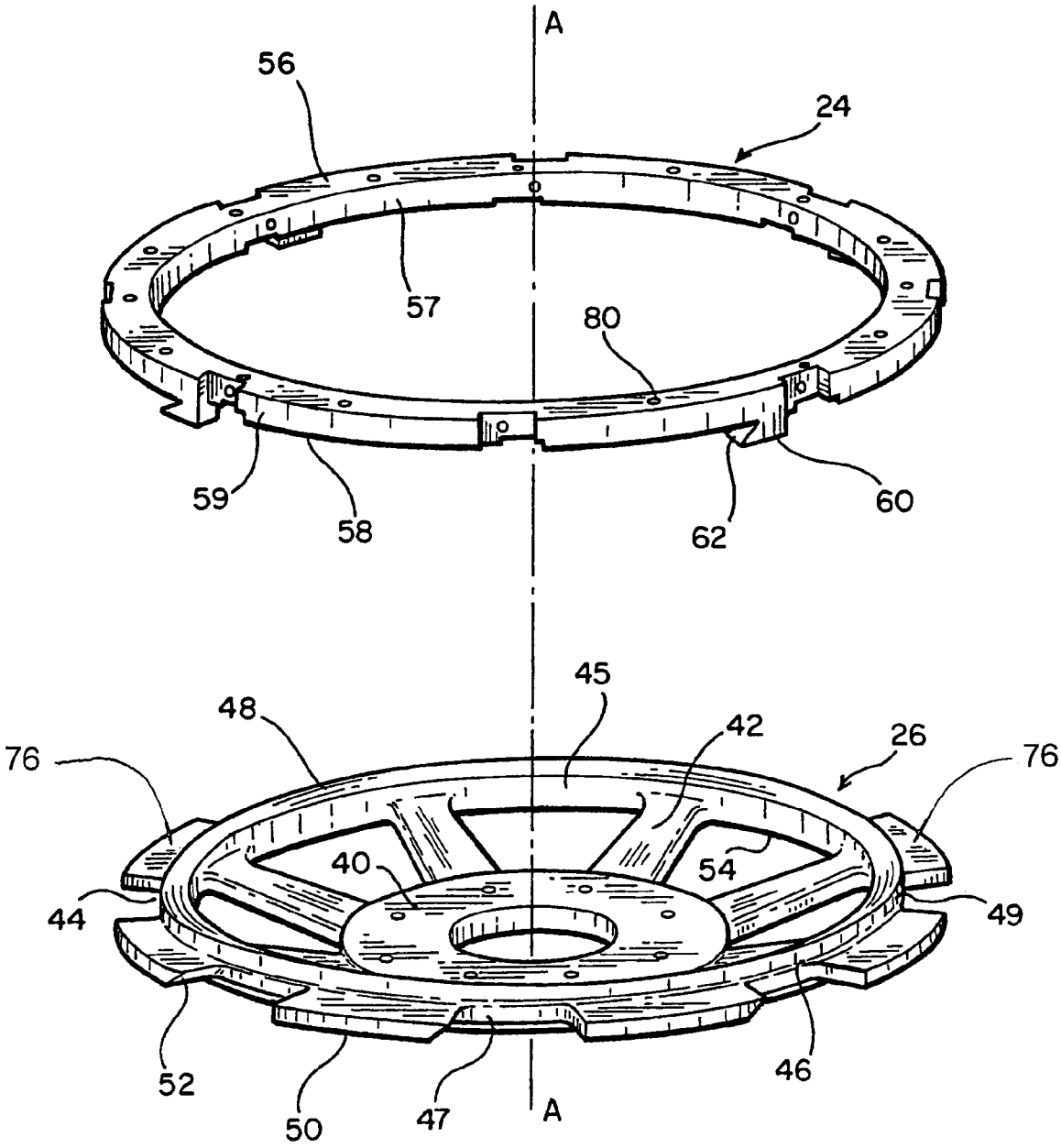
FIG. 3 is a perspective view of a support ring and a mounting ring according to a preferred embodiment of the present invention.

With reference now to the drawings, FIG. 1 shows a cutting head 10 mounted on a known slicing machine as is well known in the art and as is further described in U.S. Pat. No. 5,694,824, the entirety of which is incorporated herein by reference. The known slicing machine includes a main frame 12 upon which is mounted a drive motor 14 and a food product hopper 16. The motor 14 rotates an impeller 18 via gear box 22 such that food products dropped into the impeller are directed radially outwardly via centrifugal forces and caused to rotate by contact with the impeller blades 20 of the impeller 18. The cutting head 10 includes an upper annular ring 23 mounted on an upper side thereof and is fixedly mounted to a mounting ring 24 on a lower side thereof, which in turn is mounted on a support ring 26. The cutting head 10 is secured to the mounting ring 24, for example by fasteners, to removably attach the cutting head to the mounting ring 24. The mounting ring 24 is secured to the support ring 26 by simple friction or by suitable fasteners. The support ring 26 is fixedly attached by suitable fasteners to the housing of gear box 22.

As illustrated in FIG. 2, rotation of the impeller 18, concentrically within cutting head 10, urges food products 32 around the interior of the cutting head 10 in the rotational driving direction of the impeller 18 shown by arrow D. The cutting head 10 comprises cutting head segments 28 that carry circumferentially spaced cutting blades 30 mounted thereon. The cutting blades 30 are positioned such that they extend radially inwardly a slight distance from the adjacent portion of the cutting support segments 28 such that movement of the food product 32 in the impeller driving direction D causes slices 32*a* to be cut from the food product.

In a preferred embodiment of the invention shown in FIG. 3, a cutting head mounting and support ring assembly comprises a mounting ring 24 that is configured to connect to a known cutting head 10 in FIG. 1 and to a support ring 26 made according to the invention. As will be appreciated more fully below, the mounting ring 24 and the support ring 26 of the invention are configured to axially and circumferentially interlock with each other to secure the mounting ring against rotation in reaction to slicing forces, and against tilting relative to the support ring, preferably by a frictional interlocking scarf type joint arrangement.

The support ring 26, as illustrated in FIG. 3, preferably has an annular hub 40 arranged to be secured onto the housing of the gear box 22 of a slicing machine such, as for example, the slicing machine in FIG. 1, and is configured to permit the rotary impeller 18 to connect to the gear box 22. The support ring 26 further includes a ring portion 44 and a plurality of spokes 42 that extend from the hub 40 and connect to the ring portion 44. The ring portion 44 includes an upper, radially extending planar surface 46 defining an annular receiving area and an axially extending lip 48 extending from the upper surface 46. The annular lip 48 has an inner circumference that is shared with the inner peripheral circumference 45 of the ring portion 44 and an outer circumference 49 generally spanning the inner and outer peripheral circumferences 45, 47 of the ring portion 44. The ring portion 44 of this embodiment of the invention also includes a lower, generally radially extending surface 54 opposed and parallel to the upper surface 46.

The ring portion 44 includes a plurality of circumferentially spaced flange segments 50 projecting radially from the outer circumference 47 thereof. Each of the flange segments 50 is provided with a top surface 76 and a radially and axially extending inclined surface 52 defined at an end thereof oriented to extend at an angle relative to the axis A of the support ring 26. The inclined surfaces 52 are preferably planar and arranged on ends of the flange segments 50 that are trailing relative to the direction of driving motion of the impeller of the cutting head.

The flange segments 50 may be formed with the ring portion 44 and formed integrally in one piece therewith or, alternatively, could be formed separately and subsequently connected thereto by suitable fasteners or by being welded.

The mounting ring 24, as shown in FIG. 3, preferably includes opposed upper and lower radially extending surfaces 56, 58. The upper surface 56 is arranged to permit the cutting head 10 of the known slicing machine to be positioned thereon and permit the impeller 18 to extend therethrough. The lower surface 58 is arranged to be positioned on the upper surface 46 and the top surfaces 76 of the flange segments 50 of the mounting ring 26. The inner circumference 57 of the mounting ring 24 is sized so as to be accommodated by the annular lip 48 of the support ring 26 such that the outer circumference 49 of the annular lip 48 is generally of the same diameter as the inner circumference 57 of the mounting ring 24. The mounting ring 24 includes a plurality of holes 80 defined around the periphery thereof and arranged to receive fasteners used to connect the cutting head 10 of the slicing machine to the mounting ring 24.

The mounting ring 24 includes a plurality of circumferentially spaced projections 60 extending axially from the lower surface 58 of the ring. Each of the protrusions 60 is provided with a radially extending surface 62 oriented to extend at an inclined angle relative to the axis A of the mounting ring 24. The inclined surfaces 62 are preferably planar and complementary shaped to the inclined surfaces 52 of the support ring 26. The inclined surfaces 62 of the mounting ring 24 are arranged to mutually engage face-to-face with the inclined surfaces 52 of the support ring 26 when the mounting ring 24 is coaxially mounted on the support ring 26 with the projections interdigited with the flange segments 50, and rotated relative to the support ring 26 in a direction of driving movement of the impeller 18.

While in the preferred embodiment the flange segments 50 of the support ring 26 have a radially extending width greater than the protrusions 60 of the mounting ring 24, the flange segments 50 and the protrusions 60 may have any radially extending width sufficient for them to mutually engage and sufficiently interlock to create a positive driving connection between the mounting ring 24 and the support ring 26. Furthermore, while the support ring 26 is preferably shown to have more flange segments 50 than the axial protrusions 60 of the mounting ring 24, the support ring 26 may have any number of flange segments 50 that are sufficient to be interdigited with and interlock with any number of axial protrusions 60 of the mounting ring 24.

Figure 4:
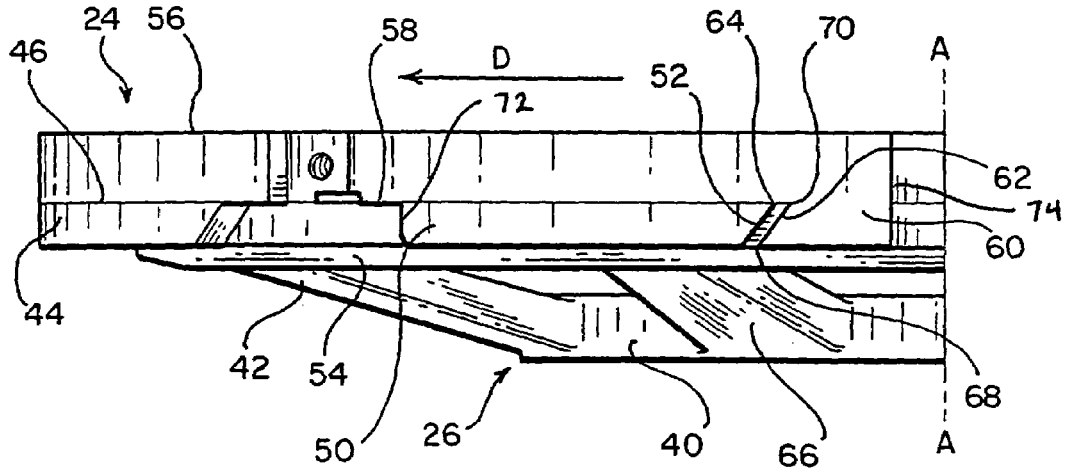
FIG. 4 is a partial, perspective view of the mounting ring of FIG. 3 connected to the support ring prior to interlocking.

As shown in FIG. 4 which illustrates the mounting ring 24 mounted on the support ring 26 with the flange segments 50 and the axial protrusions 60 interdigited and prior to interlocking with one another, the inclined surfaces 52 of the flange segments 50 are preferably configured so that a rearward edge 64 relative to the driving direction of the impeller rotation, as shown by arrow D, is generally adjacent to the upper surface 46, and an opposite rear, trailing edge is generally adjacent the lower surface 54 of the support ring 26. On the other hand, the inclined surfaces 62 of the protrusions 60 on ring 24 are preferably configured so that a rearward edge 70 relative to the impeller driving direction D defines a corner with the lower surface 58 and extends at an incline axially downwardly and forwardly therefrom relative to the impeller driving direction D and therefrom to a forward opposite edge 68.

It will be noted that the inclined surfaces 52, 62 of the mounting ring 24 and the support ring 26 are sized to have interlocking surfaces that generally have a height of the same size. In an alternate embodiment, the inclined surfaces 52, 62 can be configured to have different sizes relative to one another having sufficient overlap to accommodate one another when interlocked.

In the preferred embodiment shown in FIG. 4, the inclined surfaces 52, 62 are generally at an angle of 45°. While the angle of each of the inclined surfaces 52, 62 is preferably between the range of 30 to 60°, however, it will be noted that the angle of each of the inclined surfaces 52, 62 is not limited to this range.

Each of the flange segments 50 defines a second flange surface 72 that is located at an end opposite the inclined surface 52. Also, each of the protrusions 60 defines a second protrusion surface 74 that is located at an end opposite the inclined surface 62. The second flange surface 72 and the second protrusion surface 74 are generally parallel to axis A—A.

Figure 5:
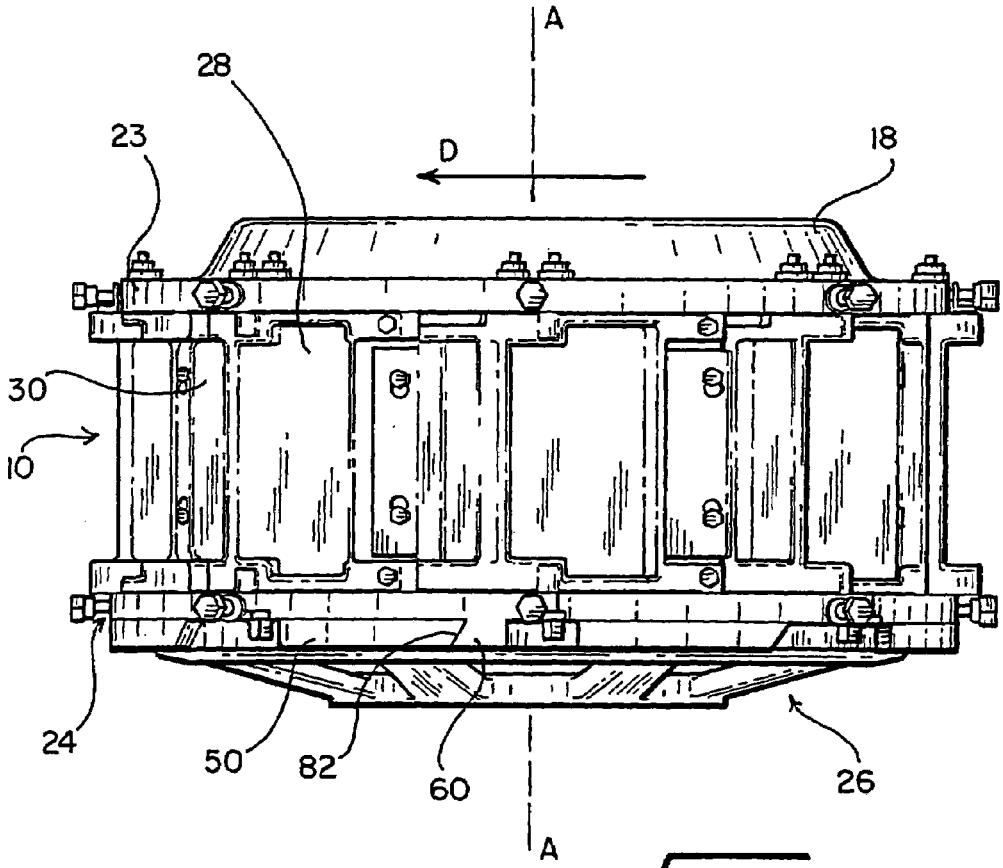
FIG. 5 is an elevational view of a cutting head assembly mounted on a mounting ring connected to a support ring having the coupling arrangement according to a preferred embodiment of the invention.

FIG. 5 illustrates the support ring 26 interlocked with the mounting ring 24 supporting the cutting head 10 and an impeller 18 arranged to rotate in the impeller driving direction D therein clockwise about axis A—A if viewed from above. As can be seen, the interlocked flange segments 50 and the axial protrusions 60 are interdigited and effectively form a scarf type joint 82 between the mounting and support rings 24, 26 that lies in a plane between the inclined surfaces 52, 62 so that a continuous line of contact is maintained between both the flange segments 50 and the axial protrusions 60. In this manner, an anti-rotation and hold-down connection is established between the cutting head 10 and mounting ring 24.

It will be noted that the inclined surfaces 52 of the flange segments 50 are arranged on a side thereof that trails the direction of rotation D of the impeller 18. On the other hand, the inclined surfaces 62 of the axial protrusions 60 are arranged on a side thereof that leads relative to the direction of rotation D of the impeller 18. It follows that due to the food products 32, for example as shown in FIG. 2, being urged radially outwardly towards the cutting blades 30 of the cutting head 10 in the direction of rotation D, the axial protrusions 60 are similarly urged against the flange segments 50, as shown in FIG. 5, due to the centrifugal forces in the direction of rotation D caused by the impeller 18 and food products 32.

As a result of the interlocking joint arrangement of the invention, the mounting ring 24 carrying the cutting head 10 can be removed from the support ring by rotating the mounting ring 24 in a direction opposite to the driving direction of rotation D of the impeller 18 to disengage from the flange segments 50 of the support ring 24 when the impeller 18 is not rotating.

While not required by the interlocking joint arrangement of the invention, the flange segments and protrusions of the support and mounting rings, respectively, may be configured to receive fasteners, such as pins, clamps or screws, to additionally secure the mounting ring and support ring together, if such a need arises.

It will be noted that the present invention is not limited to a mounting ring and a support ring each having generally inclined complementary surfaces on the flange segments and protrusions. Alternate coupling surface configurations may be substituted that have different joint forms generally configured at the same location as the preferred scarf joint connections of the invention relative to the direction of rotation of the impeller. In an alternate embodiment, the support ring, for example, may have a generally arcuate surface that is located on the leading end of the flange segments relative to the driven direction of rotation of the impeller. In such an embodiment, the mounting ring includes complementary contours on the trailing end of the protrusions that receive the arcuate surfaces of the support ring. In another alternate embodiment, the flange segments and the protrusions may have overlapping end sections that form radial and axial engaging faces when brought together in a fashion similar to a lap joint. In yet another alternate embodiment, the flange segments and the protrusions may define corresponding mortise and tenon joints, with each of the protrusions defining a tenon and each of the flange segments defining a mortise. The common characteristic that is desired in such joint configurations is that both an anti-rotation and a hold-down coupling is obtained between the mounting and support rings.

It will be readily understood that the described embodiment of the invention is exemplary only and various other features and details could be incorporated in the system described herein without departing from the spirit and scope of the invention as defined in the appended claims.

We claim:

1. A cutting head assembly for a food slicing machine comprising;

a generally circular cutting head for slicing a food product and carrying a plurality of circumferentially spaced cutting blades mounted thereon;

a rotary impeller arranged within the cutting head and to be driven in an intended driving direction of rotation about an axis of rotation located concentrically within the cutting head, the impeller having a plurality of impeller blades arranged for rotation in close approximation to the cutting blades of the cutting head;

a support ring comprising a ring portion having upper and lower surfaces and a plurality of circumferentially spaced flange segments projecting radially from the ring portion, each of said flange segments having a top surface, and including a radially and axially extending first flange surface oriented to extend at an angle relative to the axis of the support ring in an inclined direction from a forward radial edge adjacent the lower surface of the support ring directed upwardly to a rearward radial edge adjacent the upper surface of the support ring on an end of the flange segment generally opposed to a driving direction of rotation of an impeller within the cutting head, the flange segments also defining a second flange surface located at an end opposite the first flange surface and extending generally parallel to the support ring axis; and an annular mounting ring located coaxially for connection to a bottom portion of the cutting head, the mounting ring having upper and lower surfaces and a plurality of circumferentially spaced protrusions extending axially therefrom, each of said protrusions provided with a first protrusion surface oriented to extend at an angle relative to the axis of the mounting ring within an inclined direction relative to a forward radial edge directed upwardly to a rearward radial edge adjacent the lower surface of the mounting ring on an end of the protrusion generally leading in a driven direction of rotation of the impeller within the cutting head, the protrusions also defining a second protrusion surface located at an end opposite the first protrusion surface and extending generally parallel with the mounting ring axis;

wherein said protrusion surfaces of the mounting ring are complementary shaped to the flange surfaces of the support ring, said mounting ring positionable on the support ring so that the lower surface of the mounting ring is directly adjacent and flush with the top surfaces of the flange segments and the first protrusion surfaces are mutually engageable face-to-face with the first flange surfaces such that the cutting head is rotationally locked with the support ring thereby permitting the impeller to be rotatable relative to the cutting head which remains generally stationary relative to the impeller.

2. The cutting head assembly according to claim 1, wherein the protrusion surfaces are configured diagonally opposite the flange surfaces when the lower surface of the mounting ring is disposed on the upper surface of the support ring and concentric therewith with the protrusions and flange segments interdigited.

3. The ring assembly according to claim 1, wherein the support ring further includes an annular lip axially extending from the upper surface thereof having an inner circumference generally concentric with an inner peripheral circumference of the support ring and an outer circumference between the inner and outer peripheral circumferences of the support ring, an annular receiving area on the upper surface of the support ring radially extending from the outer circumference of the annular lip to the outer peripheral circumference of the support ring.

4. The ring assembly according to claim 3, wherein the mounting ring has an inner peripheral circumference sized to be received by the annular lip of the support ring and received by the annular receiving area of the support ring, the inner peripheral circumference of the mounting ring having a diameter substantially the same as the outer circumferential diameter of the annular lip.

5. The ring assembly according to claim 4, wherein the mounting ring has an outer circumference with a diameter substantially the same as the outer circumference of the support ring.

6. The cutting head assembly according to claim 1, wherein the flange segments each define a lower radial surface generally parallel to the lower surface of the ring portion of the support ring, and the protrusions define a lower radial surface such that the flange segment lower radial surfaces are generally aligned with the protrusion lower radial surfaces when the mounting ring is engaged with the support ring.

7. The cutting head assembly according to claim 1, wherein the support ring further comprises a hub and a plurality of spokes connecting the hub to the ring portion, the hub being offset relative to the ring portion along the support ring axis.

8. A ring assembly having an interlocking joint arrangement, comprising:

a support ring comprising a ring portion having upper and lower radial surfaces with a plurality of circumferentially spaced flange segments projecting radially therefrom, each of said flange segments having a top surface, and including an inclined surface oriented to extend at an angle inclined relative to the axis of the support ring; and a mounting ring having upper and lower radial surfaces and a plurality of circumferentially spaced protrusions extending axially from the lower surface, each of said protrusions provided with an inclined surface oriented to extend at an angle inclined relative to the axis of the mounting ring, said inclined surfaces of the protrusions complementary shaped to said inclined surfaces of the flange segments;

wherein the lower surface of the mounting ring is configured so as to be received by the upper surface of the support ring in a coaxial relationship with the support ring such that the lower radial surface of the mounting ring is directly adjacent and flush with the top surfaces of the flange segments and the flange segments are interlocked with the protrusions upon rotation of the mounting ring relative to the support ring in only one direction and the inclined surfaces of the protrusions mutually engage face-to-face with the inclined surfaces of the flange segments;

wherein the flange segments each define a lower radial surface generally parallel to the lower surface of the ring portion of the support ring, and the protrusions define a lower radial surface such that the flange segment lower radial surfaces are generally aligned with the protrusion lower radial surfaces when the mounting ring is engaged with the support ring.

9. The ring assembly according to claim 8, wherein the support ring further includes an annular lip axially extending from the upper surface thereof having an inner circumference generally concentric with an inner peripheral circumference of the support ring and an outer circumference between the inner and outer peripheral circumferences of the support ring, an annular receiving area on the upper surface of the support ring radially extending from the outer circumference of the annular lip to the outer peripheral circumference of the support ring.

10. The ring assembly according to claim 9, wherein the mounting ring has an inner peripheral circumference sized to be received by the annular lip of the support ring and received by the annular receiving area of the support ring, the inner circumference of the mounting ring having a diameter substantially the same as the outer circumference of the annular lip.

11. The ring assembly according to claim 10, wherein the mounting ring has an outer circumference with a diameter substantially the same as the outer peripheral circumference of the support ring.

12. The ring assembly according to claim 8, wherein the inclined surfaces of the protrusions are configured diagonally opposite the inclined surfaces of the flange segments when the lower surface of the mounting ring is received on the upper surface of the support ring and coaxial therewith.

13. The ring assembly according to claim 8, wherein the inclined surfaces of the flange segments have a rearward edge generally adjacent to the upper surface of the support ring and an opposite forward edge generally adjacent the lower surface of the support ring and in a circumferentially spaced relationship relative to the rearward edge, the inclined surfaces of the protrusions having a rearward edge generally adjacent the lower surface of the mounting ring and defining a corner therewith and an opposite forward edge in a circumferentially spaced relationship relative to the rearward edge.

14. An interlocking joint arrangement for mounting a generally circular cutting head for slicing a food product on a slicing machine, the slicing machine including a rotary impeller arranged to be driven in an intended driving direction of rotation about an axis of rotation located concentrically within the cutting head when the cutting head is mounted on the slicing machine, the slicing machine including a support ring fixedly mounted thereto and the cutting head including an annular mounting ring coaxially connected to a bottom portion thereof, the joint arrangement comprising:

the support ring having a plurality of circumferentially spaced flange segments radially extending therefrom each having a top surface, and a first radially and axially extending interlocking surface oriented at an incline relative to an axis of the support ring; and the mounting ring having a lower surface and a plurality of circumferentially spaced protrusions axially extending therefrom, each having a radially and axially extending second interlocking surface oriented at an incline relative to an axis of the mounting ring;

wherein the lower surface of the mounting ring is directly adjacent and flush with the top surfaces of the flange segments and said first and second interlocking surfaces when interlocked and placed adjacent each other define an anti-rotation and hold-down coupling restraining the support and mounting rings against relative rotation about their axes and axially separating from each other, the support and mounting rings forming the coupling upon rotation of the mounting ring relative to the support ring in only one direction;

wherein the flange segments each define a lower radial surface, and the protrusions define a lower radial surface such that the flange segment lower radial surfaces are generally aligned with the protrusion lower radial surfaces when the support ring is coupled with the mounting ring.

* * * * *